US005285765A

United States Patent [19]

Lee

[11] Patent Number: 5,285,765

[45] Date of Patent: Feb. 15, 1994

[54] MAGAZINE ASSEMBLY FOR GAS-POWERED GUN AND COMBINATION THEREOF

[76] Inventor: John P. Lee, 46 Cherry Bent Ct., Germantown, Md. 20874

[21] Appl. No.: 995,840

[22] Filed: Dec. 23, 1992

[51] Int. Cl.[5] ..... F41B 11/00

[52] U.S. Cl. ..... 124/50; 124/45; 124/49

[58] Field of Search ..... 124/50, 49, 45, 47, 124/82

[56] References Cited

U.S. PATENT DOCUMENTS

| | | | |
|---|---|---|---|
| 2,633,838 | 8/1948 | Seward . | |
| 3,447,527 | 4/1966 | Cermak . | |
| 3,911,888 | 10/1975 | Horvoth . | |
| 3,989,027 | 11/1976 | Kahelin | 124/50 |
| 4,531,503 | 7/1985 | Shepherd | 124/50 |
| 4,602,608 | 7/1986 | Lacam . | |
| 4,896,646 | 1/1990 | Kahelin | 124/50 |
| 4,936,282 | 6/1990 | Dobbins . | |
| 4,995,371 | 2/1991 | Kuizinas | 124/50 |

*Primary Examiner*—Randolph A. Reese
*Assistant Examiner*—Anthony Knight
*Attorney, Agent, or Firm*—Richard C. Litman

[57] ABSTRACT

A gas-powered paint ball gun in which a magazine is attached tangentially to a firing chamber or barrel. An opening is provided in the magazine so as to release back-pressure. Paint balls are fed into the firing chamber through the magazine in a direction tangent to the firing chamber and in a direction perpendicular to the radial direction of the firing chamber or barrel. The paint balls being loaded into the firing chamber each have a limited radial distance to travel and therefore have a limited travel period. The unique configuration enables each paint ball being loaded into the chamber to come to rest in the firing chamber more rapidly and thereby reduces the risk of the gun becoming jammed. Further, this configuration enables the gun to be fired more rapidly and with greater assurance that the gun will not jam.

19 Claims, 3 Drawing Sheets

MAGAZINE ASSEMBLY FOR GAS-POWERED GUN AND COMBINATION THEREOF

BACKGROUND OF THE INVENTION

1. Field of the Invention

The present invention relates generally to mechanical guns, and more particularly to a magazine assembly for gas-powered guns. The present invention is especially useful for semi-automatic paint ball guns.

2. Description of the Prior Art

It has been well-known to use marking guns for wild animal management and in strategic or tactical games, such as paint ball games. The marking gun generally uses a liquid-containing frangible projectile commonly known as a paint ball. The paint ball is designed to be broken upon impact with an intended target. A player in a paint ball game generally fires a large quantity of paint balls in rapid succession. Because of the rapid discharge of the paint balls, several feed mechanisms have been devised. One such feeding mechanism is shown in U.S. Pat. No. 2,633,838 issued Apr. 7, 1953 to Seward. Seward discloses a magazine placed parallel to the barrel of the gun. This parallel displacement requires a user to arduously slant the gun in order to load a projectile.

An alternative feeding device is shown in U.S. Pat. No. 4,936,282 issued Jun. 26, 1990 to Dobbins et al. Dobbins discloses the magazine attached perpendicularly to the barrel. The magazine contains a column of paint balls which are aligned in a radial direction relative to the barrel. Through gravitational force, a paint ball drops into the barrel when the bolt of the gun is retracted. The retraction of the bolt creates back-pressure whereby the external air is sucked into the gun through the barrel. The back-pressure moves the column of paint balls upwardly and away from the barrel. Consequently, it takes more time to load a paint ball into the barrel which is sometimes longer than time required to reset the bolt. This increases the risk of the bolt rupturing the paint ball thereby jamming the gun.

U.S. Pat. No. 3,447,527 issued Jun. 3, 1969 to Cermak et al. and U.S. Pat. No. 4,602,608 issued Jul. 29, 1986 to Lacam et al. each disclose a magazine located below and attached perpendicularly to a barrel. A column of projectiles are biased toward and loaded into the barrel by a spring. This type of gun does not use gravitational force to load each paint ball, and is more complicated in construction.

Another patent which may be deemed of interest is U.S. Pat. No. 3,911,888 issued Oct. 14, 1975 to Horvath which discloses a pneumatic ball thrower.

Applicant's instant invention is a magazine assembly comprising a magazine and a collar which may be slidably attachable to the barrel of a paint ball gun or a magazine which may be fixed to the barrel of a paint ball gun. The magazine is orientated tangential to the barrel, not perpendicular or parallel. A ball drops into the barrel at an angle 90° with respect to the magazine. This reduces the travel of the paint ball being loaded into the barrel and therefore, reduces the risk of the bolt rupturing the paint ball and jamming the gun. The magazine uses gravitational force to load each paint ball, and thus achieves a simple construction.

SUMMARY OF THE INVENTION

The present invention relates to a magazine assembly for gas-powered gun, such as a paint gun, which comprises a magazine attached tangentially to a collar or directly to the barrel of the gun. The collar slidably engages the barrel of the gun and is fixed to the barrel about the firing chamber of the gun or the magazine is fixed directly to the barrel proximate the firing chamber. The magazine is adapted to store a plurality of frangible projectiles, hereinafter identified as paint balls, each of which is configured to break upon impact with an intended target. The magazine is tubular in shape having a first opening at an uppermost end thereof and a second opening at an opposite end. A third opening is provided in a side wall of the tubular shaped magazine proximate the second opening. This third opening communicates with the collar and the firing chamber. Opposite the third opening is a forth opening which is also in the sidewall of the magazine. Paint balls are fed into the magazine through the first opening and are encouraged to flow in a downward direction through gravitation force, thus eliminating the need for mechanical biasing devices and rendering the configuration of the magazine simplistic in form. A plug is insertable into the second opening. The plug has a curved surface which is directed interiorly of the magazine when inserted therein. The plug may be oriented so that the curvature guides paint balls through the third opening into the firing chamber of the gun when the bolt is retracted. By rotating the plug 180 degrees, the plug functions as a safety to obstruct the third opening and prevent paint balls from entering therethrough into the firing chamber. The forth opening serves two purposes, namely: to provide ventilation to relieve back pressure created by the bolt action; and to permit the user to view paint balls in the magazine adjacent the third opening. The forth opening is small enough so as to prevent a paint ball from passing therethrough. The plug and the tangential orientation of the magazine relative to the collar and, in turn, the barrel cooperate to direct the ball into the firing chamber at an angle 90 degrees relative to the magazine. Further, the orientation of the magazine relative to the firing chamber and the 90 degree displacement of the paint ball reduces the distance in which a paint ball being loaded into the chamber may travel. This reduces the travel time of the paint ball being loaded into the firing chamber or reduces the time period which is required for a paint ball to reach a static state within the firing chamber and thereby, reduces the risk of the paint ball being ruptured by the bolt and jamming the gun.

Accordingly, it is a general object of the present invention to provide a novel and useful magazine configuration for gas-powered guns in which the relationship between the magazine and the barrel of the gun limits the travel of a paint ball being loaded into the firing chamber, limiting the time period which is required for the paint ball to come to rest in the firing chamber, reducing the risk of the paint ball being ruptured by the bolt of the gun and thereby, reducing the risk of the gun becoming jammed by the paint ball.

Another object is to configure the magazine assembly in such a manner that the travel time for a paint ball being loaded is minimized, thus maximizing rate in which paint balls may be loaded into the firing chamber, enabling the user to fire the gun more rapidly.

Still another object is to configure the magazine such that the paint balls being loaded are effected by gravitational forces requiring no supplemental bias and hence, is simplistic in construction.

Other objects and further features of the present invention will become apparent from the following detailed description when read in conjunction with the accompanying drawings.

DETAILED DESCRIPTION OF THE PREFERRED EMBODIMENTS

Figure 2:
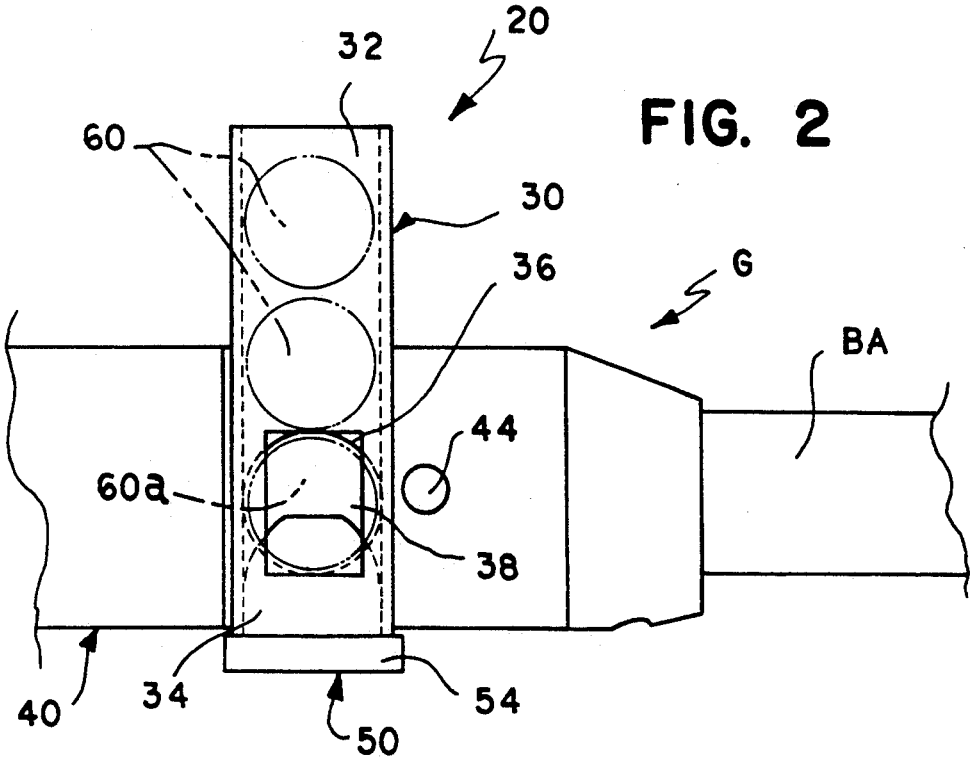
FIG. 2 shows a plan view of the magazine assembly as shown in FIG. 1.
Figure 3:
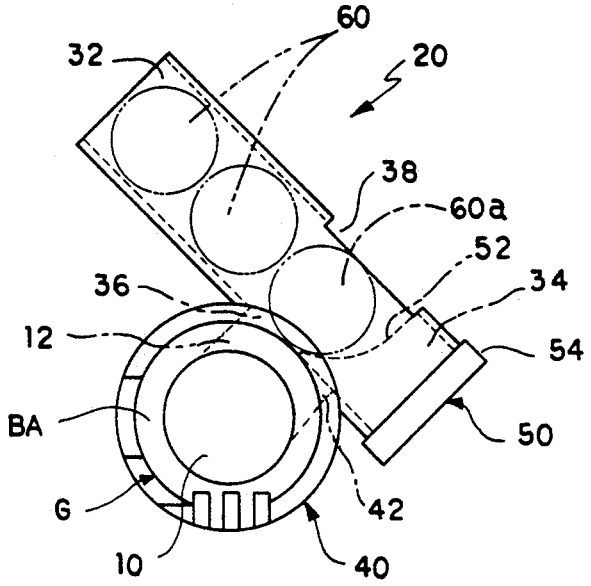
FIG. 3 shows a rear view of the magazine assembly as shown in FIG. 1 showing in hidden lines the plug thereof turned so as to prevent paint balls from entering a firing chamber.

A description will be given, with reference to FIGS. 1 through 3, of a magazine assembly 20 for use with gas-powered guns G. The assembly 20 is configured so as to introduce a unique relationship between the firing chamber 10 of the gun G and the magazine 30 of the magazine assembly 20. The magazine assembly 20 comprises the magazine which may be fixed to the barrel BA of a gun G. However, in the drawings, the magazine assembly 20 is shown to comprise the magazine 30 and a collar 40, wherein the magazine 30 is coupled with the collar 40, which slidably engages the barrel BA of the gun G and is fixed relative to the barrel BA proximate between the magazine 30 and the firing chamber 10 of the gun G. The magazine 30 facilitates loading frangible paint balls 60, hereinafter known as paint balls, into the firing chamber 10.

The magazine 30 has a tubular shape and stores therein a column of paint balls 60. The magazine 30 is attached tangentially either directly to the barrel BA of the gun G or to the collar 40, as shown. Therefore, the column of paint balls 60 are aligned in a tangential direction T relative to the collar 40 (or the firing chamber 10 and barrel BA). As shown in FIGS. and 2, an elevational angle between the magazine 30 and the collar 40 (or the firing chamber 10 and barrel BA), that is an angle formed by the tangential direction T and a horizontal direction H relative to the collar 40, is 45°. Incidentally, the present invention can be applied to a different elevational angle other than 45°.

The magazine 30 has a first opening 32 located at an uppermost end thereof and a second opening 34 at an opposite end. A third opening 36 is located in the sidewall of the magazine 30 proximate the second opening 34. The third opening 36 communicates with a first opening 42 in the collar 40 and a first opening 12 in the firing chamber 10. Paint balls 60 are supplied to the magazine 30 through the first opening 32. The paint balls 60 are directed downward in the direction T by the gravitational force and hence, require no supplemental biasing element. Each paint ball 60 supplied through the magazine 30 is directed through the third opening 36 in the magazine 30, the first opening 42 in the collar 40, and the first opening 12 in the firing chamber 10. This is accomplished via a guide member or plug 50 which is insertably engagable into the second opening 34 in the magazine 30. The plug 50 is provided with a curved surface which, when inserted into the second opening 34, is directed interiorly of the magazine 30. The plug 50 may be oriented so as to direct the paint balls 60 through the third opening 36 in the magazine 30 at an angle 90° relative to thereto or may be rotated 180° to obstruct the third opening 36 and prevent paint balls 60 from entering into the firing chamber 10.

The barrel BA of the gun G communicates with the firing chamber 10. A first opening 12 is located in the sidewall of the firing chamber 10 and communicates with the first opening 42 in the collar and the third opening 36 in the sidewall of the magazine 30. The first opening 12 in the firing chamber 10 is provided so as to permit a paint ball 60 to be loaded therein. The first opening 12 in the firing chamber 10, the first opening 42 in the collar 40, and the third opening 36 in the sidewall of the magazine 30 are aligned with each other in a radial direction R relative to the firing chamber 10. Consequently, each paint ball 40 is supplied from the magazine 30 to the firing chamber 10 through the first opening 12 in the firing chamber, the first opening 42 in the collar 40, and the third opening 36 in the magazine 30. The openings 12,42,36 are formed in a circular shape, as shown in FIG. 2, and are dimensioned so as to permit each paint ball 40 to appropriately drop therethrough and be loaded into the firing chamber 10.

The magazine 30 has a fourth opening 38 opposite to the third opening 36. As shown in FIG. 2, the fourth opening 38 has a rectangular shape and is larger than the openings 12,42,36 formed in the firing chamber 10, the collar 40, and the magazine 30. As shown in FIG. 1, the first opening 12 in the firing chamber, the first opening 42 in the collar 40, the third opening 36 in the magazine 30 adjacent the firing chamber 10, the fourth opening 38 in the magazine 30 opposite the third opening 36, and the lowermost paint ball 50*a* are aligned with each other in the radial direction R relative to the firing chamber 10.

The plug 50 guides each paint ball 40 one by one from the magazine 30, through the collar 40, and into the firing chamber 10. The plug 50 comprises the curved guide surface 52 and a head 54. The guide surface 52 supports the lowermost paint ball 60*a*, and has a concave shape so as to appropriately support the lowermost paint ball 60*a*. For example, if the paint ball 60 has a spherical shape, the guide surface 52 has a corresponding spherical concave shape. Preferably, the guide surface 52 is so inclined that the lowermost paint ball 60*a* drops in a direction opposite to the direction R. In other words, the guide surface 52 alters a dropping direction of the lowermost paint ball 60*a* by an angle 90° relative to the tangent line T. However, the present invention can be applied to any inclined angle of the guide surface 52. The head 54 is rotatable around the tangent line T in a direction A and B. Therefore, by manually rotating the head 54 in the direction A or B, the guide surface 52 is responsively rotated between a first position shown in FIG. 1 and a second position shown in FIG. 3. When the plug 50 is located at the first position shown in FIG. 1, the guide surface 52 faces the first opening 12 in the firing chamber 10, the first opening 42 in the collar 40, and the third opening 36 through the magazine 30 to partially seal the fourth opening 38 in the magazine 30 opposite the third opening 36, as shown in FIG. 2. The fourth opening 38, when partially sealed by the plug 50, is too small to allow the lowermost paint ball 60*a* to pass therethrough. An the other hand, when the plug 50 is rotated to the second position shown in FIG. 3, the guide surface 52 faces the fourth opening 38 in the magazine 30 and partially seals the third opening 36. The third opening 36, when partially sealed by the plug 50, is too small to allow the lowermost paint ball 60*a* to drop therethrough.

Next follows a description of a basic operation of a gun G employing the magazine assembly 20. It should be noted that a conventional firing unit (not shown) fires each paint ball 60 from the barrel BA of the gun G toward an intended target (also not shown). The firing unit uses compressed gas to fire each paint ball 60. Before a paint ball 60 is fired, the plug 50 must be located at the first position shown in FIG. 1. The moment the firing unit fires the paint ball 60, the retraction of the bolt BO (shown in FIG. 4) of the firing unit creates the back-pressure and the external air is sucked into the firing chamber 40 through the bore of the barrel BA. The external air applies compressed pressure to the firing chamber 40 in the radial direction R. Consequently, the lowermost paint ball 60*a*, which is the next paint ball to be loaded, is compressed toward the guide surface 52. However, since the plug 50 partially seals the fourth opening 38, the lowermost paint ball 60*a* is prevented from passing therethrough. The compressed air is released from the unsealed fourth opening 38 to the outside. Then, the lowermost paint ball 60*a* drops to be loaded into the barrel BA via the first opening 12 in the firing chamber 10, the first opening 42 in the collar 40, and the third opening 36 in the magazine 30. The firing chamber 10 may have a second opening 14 and the collar 40 may have a second opening 44 corresponding to the second opening 14 in the firing chamber 10, as shown in FIG. 2. These openings 14,44 would provide supplemental relief of the back-pressure produced by the bolt BO action.

During this loading procedure, the compressed air created by the back-pressure does not affect the rest of the paint balls 60 above the lowermost paint ball 60*a*. That is because the compressed air goes in the radial direction R, and there is no other paint balls 60 except the lowermost paint ball 60*a* in the magazine 30 in the path of the direction R. In addition, the lowermost paint ball 60*a* is limited in its travel in the direction R by the guide surface 52. Therefore, the lowermost paint ball 60*a* can come to rest in the firing chamber 10 more rapidly than the bolt BO can be reset. As a result, the risk of the lowermost paint ball 60*a* jamming in the gun G is minimized. Incidentally, if the corresponding openings 14, 44 are provided in the firing chamber 10 and the collar 40, the compressed air is released more rapidly, and thus the lowermost paint ball 60*a* can be loaded even more rapidly.

When the user stops firing the gun, the plug 50 may be rotated to the second position. In this position, the guide surface 52 prevents the lowermost paint ball 60*a* from dropping into the barrel BO by partially blocking the third opening 36. The fourth opening 38 is dimensioned such that the lowermost paint ball 60*a* cannot pass therethrough when the plug 50 is located at the second position.

It should be noted that as long as the magazine 30 is attached tangentially to the collar 40 at a position where the lowermost paint ball 60*a* is located, other configurations are within the scope of the present invention. For example, the magazine 30 shown in FIG. 1 may curve upwardly. In addition, as long as the magazine 30 is attached tangentially to the barrel BA with respect to the plane which is not perpendicular to the longitudinal direction of the barrel BA, such a configuration is within the scope of the, present invention. The present invention may also be applied to guns other than gas-powered guns G so long as the bolt is retractable in the barrel BA and a back-pressure is produced by the retraction.

Figure 1:
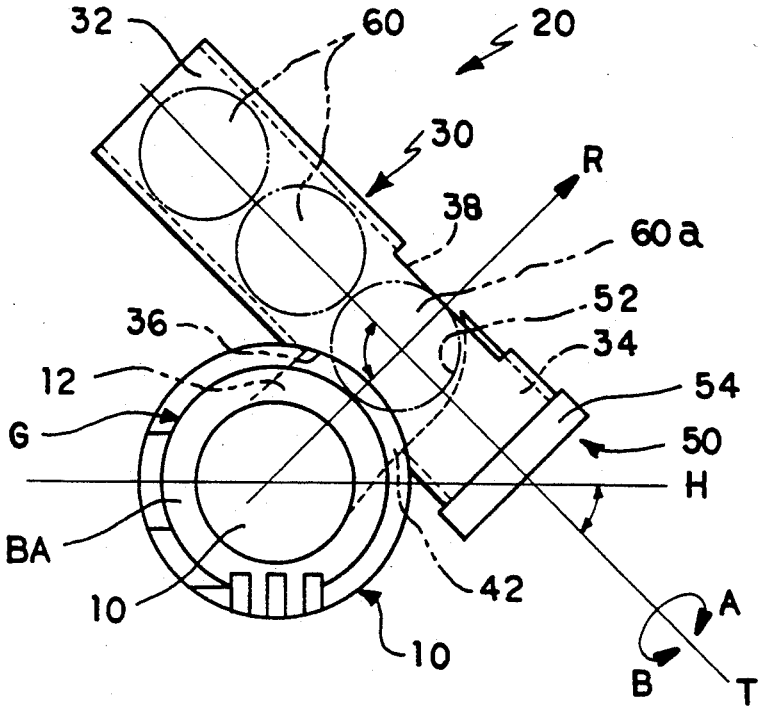
FIG. 1 shows a rear view of a magazine assembly for use with a gas-powered gun showing of detail in hidden lines.
Figure 4:
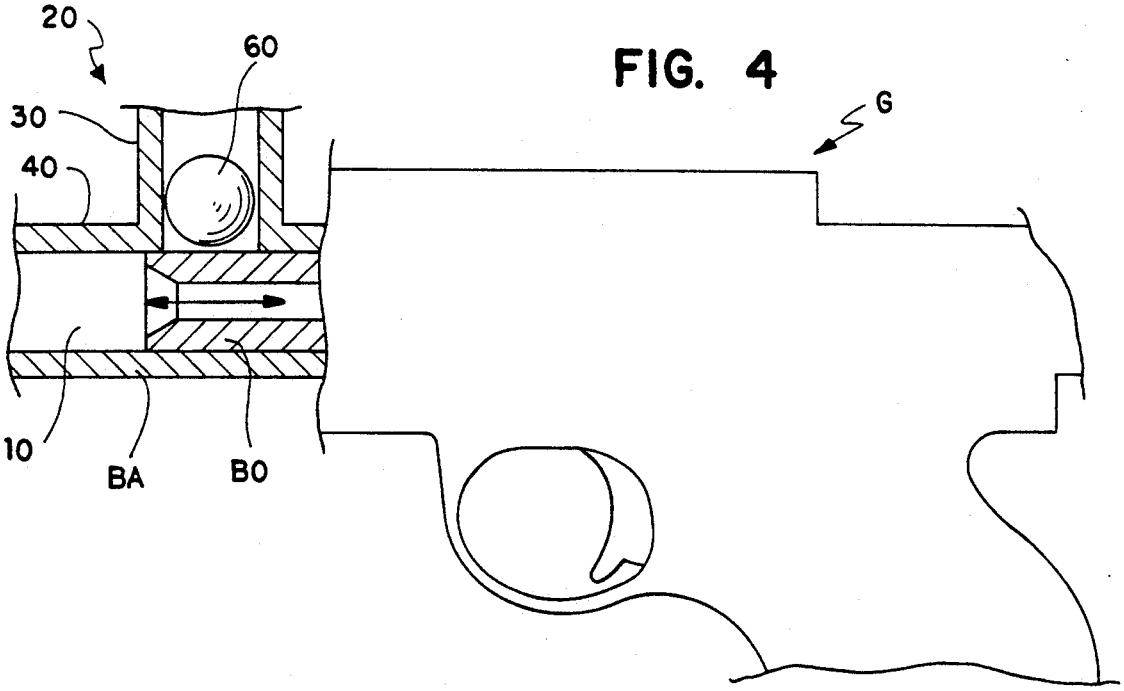
FIG. 4 shows a partial cross sectional view of a gun having the magazine assembly attached thereto.

FIG. 4 briefly shows a gun G having attached thereto the magazine assembly 20 shown in FIG. 1. The present invention is preferably used for semi-automatic guns having a gas-powered firing unit, for example, guns using a valve mechanism as disclosed in U.S. Pat. No. 4,936,282. Nevertheless, the present invention may be applied to guns using other firing units, such as a manual cocking mechanism as disclosed in U.S. Pat. No. 2,633,838. The aforementioned references respectively fully disclose their firing units, and thus a duplicate description thereof will be omitted.

Figure 5:
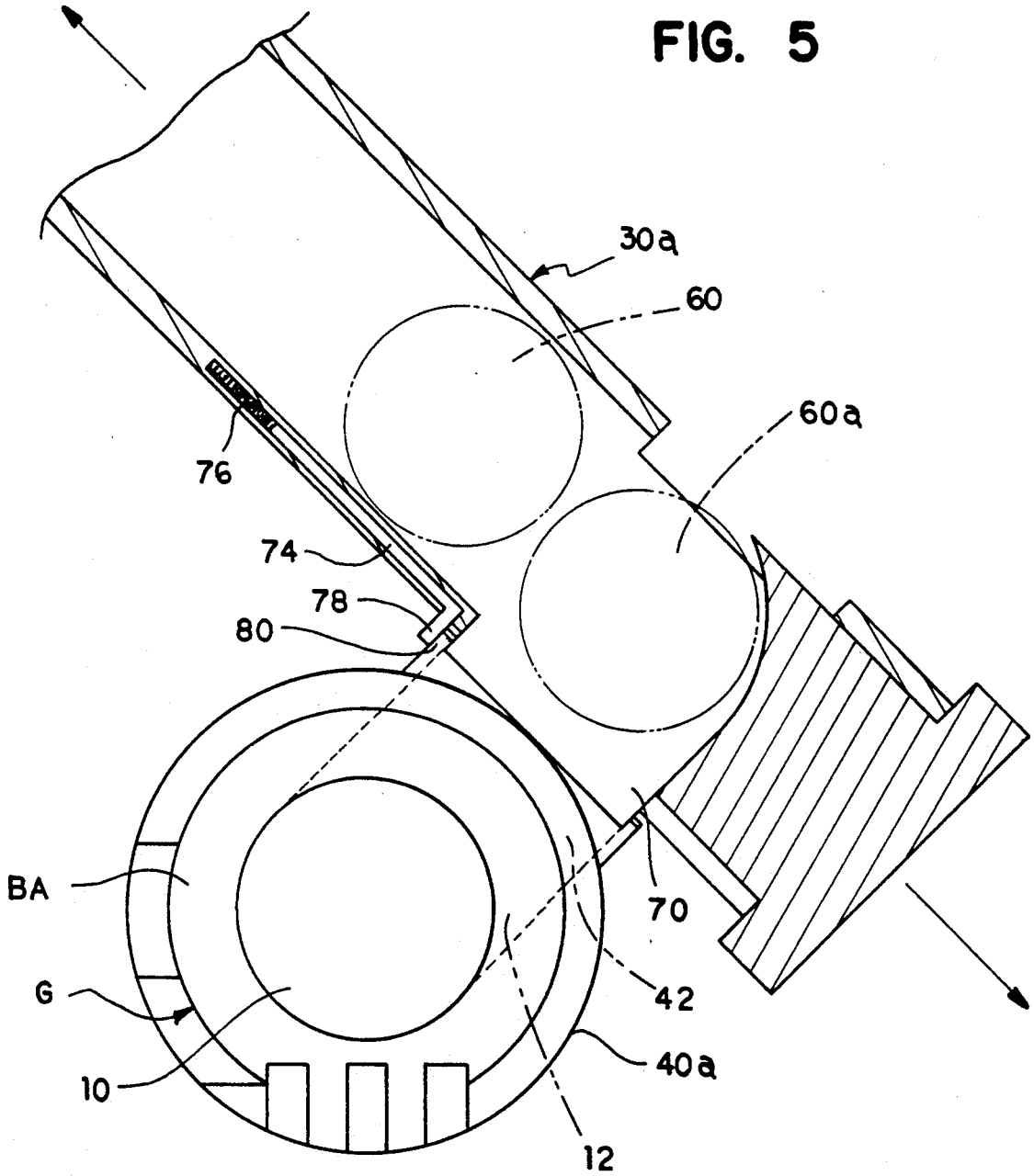
FIG. 5 shows an rear view of an alternative magazine assembly.

Incidentally, the magazine 30*a* may be engagable with and disengagable from the collar 40*a*. As shown in FIG. 5, the collar 40*a* may include a pair of rail receivers 70, and the magazine 30*a* may include a pair of rails 72. The rails 72 can be engaged with and disengaged from the rail receivers 70. The first opening 42 in the collar 40 is provided between the rail receivers 40*a*. The third opening 36 in the magazine 30*a* is provided between the rails 72. This configuration is suitable for the paint ball game. In this case, each player of the paint ball game would have a plurality of manifolds (not shown) each loaded with a plurality of paint balls 60 and each having attached thereto a separate magazines 30*a* in advance. During the paint ball game, if the paint balls 60 are exhausted from one manifold, the player may disengage the magazine 30*a* associated therewith and exchanges it with a new magazine 30*a* associated with a full manifold. Needless to say, another engagement and disengagement mechanism may be used instead of the rails 72 and the rail receiver 70 shown. In addition, the number of the rails 72 and rail receivers 70 are not limited to two.

Moreover, a shutter 74 and a compression spring 76 may be attached to the magazine 30*b* so as to close the third opening 36, whereas a shutter opener 78 is attached to the collar 40*b* above the first opening 42 therein. The shutter 74 is dimensioned such that it sufficiently covers the third opening 36 in the magazine 30. The shutter 74 includes a tab 80 which is engagable with the shutter opener 78. In this case, the shutter 74 normally closes the third opening 36 in the magazine 30*b* by means of the elastic force of the compression spring 76 while the plug 50 partially seals the fourth opening 38. Thus, the paint balls 60 in the magazine 30*b* are not permitted to pass through the openings 36,38 therein when the magazine 30*b* is not engaged with the collar 40*b*. When the magazine 30*b* is engaged with the collar 30*b*, the shutter opener 78 is engaged with the tab 80 and biases the tab 80 as the magazine 30*b* is applied. As a result, the shutter 74 gradually reveals the third opening 36 in the magazine 30*b*. When the magazine 30*b* is completely engaged with the collar 40*b*, the first opening 42 in the collar 40*b* is in communication with the third opening 36 in the magazine 30*b*. Alternatively, a shutter 74 may be provided so as to close the fourth opening 38 in the magazine 30 and the plug 50 may be located at the second position so as to partially seal the third opening 36.

It should be noted that the magazine 30 may be fixed directly to the barrel BA of the paint ball gun G eliminating the need for a collar 40. Hence, the magazine 30 having a tangential orientation relative to the barrel BA may be considered a component part of a paint ball gun G.

Further, the present invention is not limited to these preferred embodiments, and various variations and modifications may be made without departing from the scope of the present invention.

What is claimed is:

1. A magazine assembly attachable to a barrel of a gun, the barrel having a firing chamber, the firing chamber having a first opening, said magazine assembly comprising:

a magazine for storing therein a plurality of frangible projectiles each of which is configured to break upon impact with an intended target, said magazine having means defining a first opening, a second opening, a third opening, and a fourth opening, each of said projectiles being supplied to said magazine through said first opening thereof, said second opening being located opposite to said first opening of said magazine, said third opening being located opposite to said fourth opening;

a collar, to which said barrel is slidably attachable so that the firing chamber of the barrel can be accommodated into said collar, said collar having means defining a first opening, said first opening of said collar being coupled together with said third opening of said magazine, said first opening of said collar being coupled together to the first opening of the firing chamber when the barrel is attached to said collar, said magazine being attached tangentially to said collar, each of said projectiles being supplied from said magazine through said third opening of said magazine and said first opening of said collar; and a guide member, coupled to said magazine, which supports a lowermost projectile of the plurality of frangible projectiles, said guide member facing said third opening of said magazine, whereby the lowermost projectile is allowed to drop to be loaded into the firing chamber through said first opening in the firing chamber through said third opening of said magazine and said first opening of said collar while prevented from dropping off through said fourth opening of said magazine, said fourth opening of said magazine being dimensioned so as to ventilate said collar even when said lowermost projectile is aligned with said third opening and said fourth opening of said magazine, and said first opening of said collar.

2. The magazine assembly according to claim 1, wherein said fourth opening of said magazine is dimensioned so as to not permit a projectile to pass therethrough.

3. The magazine assembly according to claim 1, further includes means to attach said magazine tangentially to said collar along a tangent line on a plane perpendicular to a longitudinal direction of said collar.

4. The magazine assembly according to claim 1, further including means to rotate said guide member wherein said guide member is rotatable between a first position and a second position, said guide member located at the first position facing said third opening of said magazine whereby the lowermost projectile is allowed to drop to be loaded into the firing chamber through said third opening of said magazine and said first opening of said collar while being prevented from dropping off through said fourth opening of said magazine, and said guide member located at the second position facing said fourth opening of said magazine whereby the lowermost projectile is prevented from dropping into the firing chamber through said first opening in said collar and said third opening in said magazine.

5. The magazine assembly according to claim 1, wherein said guide member includes a curved surface so as to direct the lowermost projectile in a first direction to drop to be loaded through said collar into the firing chamber, said first direction being perpendicular to a second direction in which a frangible projectile subsequent to said lowermost projectile moves, whereby when said lowermost projectile is loaded into the firing chamber, said the frangible projectile subsequent to said lowermost projectile moves to a position where said lowermost projectile is located.

6. The magazine assembly according to claim 1, wherein the firing chamber includes a second opening and said collar includes a second opening corresponding to the second opening of the firing chamber, said second opening of said collar and said second opening of the firing chamber for ventilating the firing chamber.

7. The magazine assembly according to claim 1, wherein said guide member has a concave surface so as to appropriately support the lowermost projectile.

8. The magazine assembly according to claim 7, wherein a surface of each of said frangible projectiles each has a spherical surface and said concave surface is spherical so as to correspond to the spherical surface of the frangible projectiles.

9. The magazine assembly according to claim 1, wherein an elevational angle between said magazine and said collar is 45°.

10. The magazine assembly according to claim 1, further including means to selectively engage said magazine with and disengage from said collar.

11. The magazine assembly according to claim 10, wherein said magazine comprises rail means near said third opening thereof, and wherein said barrel comprises rail receiving means near the first opening of said collar, which is engagable with and disengagable from said rail means, said first opening of said collar being coupled together with said third opening of said magazine when said rail means is completely engaged with said rail receiving means.

12. The magazine assembly according to claim 11, wherein said rail means comprises a pair of rails, and said rail receiving means comprises a pair of rail receiver, said third opening of said magazine being provided between said pair of rails, and said first opening of said collar being provided between said pair of rail receivers.

13. The magazine assembly according to claim 10, wherein said magazine comprises shutter means for closing said third opening of said magazine when said magazine is disengaged from said collar.

14. The magazine assembly according to claim 4, wherein said magazine is engagable with and disengagable from said collar, and comprises shutter means for closing said fourth opening of said magazine when said magazine is disengaged from said collar.

15. The magazine assembly according to claim 13, further comprises:

biasing means, coupled to said shutter means, for biasing said shutter means to close said third opening of said magazine; and a first member attached to said shutter means, and wherein said collar comprises a second member, engagable with said first member which opens said shutter means via said first member, whereby said shutter means gradually opens said third opening of said magazine against the bias said biasing means as said rail means is being engaged with said rail receiving means, and said shutter means completely opens said third opening of said magazine when said rail means is completely engaged with said rail receiving means.

16. The magazine assembly according to claim 1, wherein said magazine has a tubular shape so as to store a column of said plurality of frangible projectiles, and said column being aligned tangentially with respect to said collar.

17. The magazine assembly according to claim 1, wherein said guide member comprises a head covering said second opening of said magazine, said head being engagable with and disengagable from said magazine.

18. A gun comprising:

a barrel including a firing chamber, the firing chamber has a first opening;

a magazine assembly, attachable to said barrel of said gun, said magazine assembly including:

a magazine which stores therein a plurality of frangible projectiles each of which is designed to be broken upon impact with an intended target, said magazine having means defining a first opening, a second opening, a third opening, and a fourth opening, each of the projectiles being supplied to said magazine through said first opening thereof, said second opening being located opposite to said first opening of said magazine, said third opening being located opposite to said fourth opening, said magazine being attachable to said barrel so that said third opening of said magazine is coupled together to said first opening of said firing chamber, said magazine being attached tangentially to said barrel, each of the projectiles being supplied from said magazine through said third opening of said magazine and said first opening of said barrel, and a guide member, coupled to said magazine, which supports a lowermost projectile of the plurality of frangible projectiles, said guide member facing said third opening of said magazine, whereby the lowermost projectile is allowed to drop to be loaded into said firing chamber through said third opening of said magazine while prevented from dropping off through said fourth opening of said magazine, said fourth opening of said magazine being dimensioned so as to ventilate said barrel even when the lowermost projectile is aligned with said third opening and said fourth opening of said magazine; and a firing unit, coupled to said firing chamber of said barrel, which is purposed to fire each of the projectiles toward the intended target.

19. The gun according to claim 18, wherein said firing unit uses compressed air to fire each of the projectiles.

* * * * *